US008517114B2

(12) United States Patent
Nevels et al.

(10) Patent No.: US 8,517,114 B2
(45) Date of Patent: Aug. 27, 2013

(54) MECHANICAL LOCK WITH PRESSURE BALANCED FLOATING PISTON

(75) Inventors: David L. Nevels, Spring, TX (US); Louis M. Gambertoglio, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 454 days.

(21) Appl. No.: 12/713,310

(22) Filed: Feb. 26, 2010

(65) Prior Publication Data

US 2011/0209867 A1 Sep. 1, 2011

(51) Int. Cl.
*E21B 23/00* (2006.01)
*E21B 17/00* (2006.01)

(52) U.S. Cl.
USPC ..... 166/377; 166/242.6

(58) Field of Classification Search
USPC ..... 166/181, 381, 374, 376, 169, 205, 166/377, 242.6; 285/83, 102, 306
See application file for complete search history.

(56) References Cited

U.S. PATENT DOCUMENTS

| | | | | | |
|---|---|---|---|---|---|
| 3,237,637 | A | * | 3/1966 | Ainsworth | 137/251.1 |
| 3,237,695 | A | * | 3/1966 | Bostock et al. | 166/120 |
| 3,678,998 | A | * | 7/1972 | Cockrell et al. | 166/123 |
| 4,508,167 | A | | 4/1985 | Weinberg et al. | |
| 4,660,637 | A | * | 4/1987 | McGill et al. | 166/120 |
| 4,880,059 | A | * | 11/1989 | Brandell et al. | 166/332.4 |
| 5,462,121 | A | | 10/1995 | Schmuck et al. | |
| 5,579,840 | A | * | 12/1996 | Saurer | 166/123 |
| 5,695,009 | A | * | 12/1997 | Hipp | 166/196 |
| 5,794,694 | A | * | 8/1998 | Smith, Jr. | 166/212 |
| 5,810,082 | A | * | 9/1998 | Jordan, Jr. | 166/120 |
| 5,826,652 | A | | 10/1998 | Tapp | |
| 6,571,879 | B1 | | 6/2003 | Bebak et al. | |
| 7,114,573 | B2 | * | 10/2006 | Hirth et al. | 166/382 |
| 7,426,964 | B2 | | 9/2008 | Lynde et al. | |
| 7,503,390 | B2 | | 3/2009 | Gomez | |
| 2006/0108152 | A1 | * | 5/2006 | Lee | 175/317 |
| 2009/0107686 | A1 | * | 4/2009 | Watson | 166/381 |
| 2009/0200040 | A1 | * | 8/2009 | Smith et al. | 166/380 |

OTHER PUBLICATIONS

Hodges, Steven, et al., "Hydraulically-Actuated Intelligent Completions: Development and Applications",OTC 11933, May 2000, 1-16.
King, James, et al., "A Methodology for Selecting Interventionless Packer Setting Techniques", SPE 90678, Sep. 2004, 1-11.
Bisset, Stephen, et al, "Interventionless Packer Setting Devices and Their Roles", OTC 21541, May 2011, 1-5.

* cited by examiner

*Primary Examiner* — Jennifer H Gay
*Assistant Examiner* — Michael Wills, III
(74) *Attorney, Agent, or Firm* — Steve Rosenblatt

(57) ABSTRACT

Parts that need to be retained against relative movement are held with at least one collet that is captured in a groove with sleeve that acts as a piston. The piston is exposed to tubing pressure on opposed ends to be in pressure balance despite variations of pressure in the tubing. When it is desired to allow relative part movement to actuate the tool, one of the ports to the piston is isolated from the other and pressure drives the piston in a downhole direction. This releases the collet and drives a sleeve in an opposite direction to actuate a tool. The parts can be optionally rotationally locked.

20 Claims, 2 Drawing Sheets

MECHANICAL LOCK WITH PRESSURE BALANCED FLOATING PISTON

FIELD OF THE INVENTION

The field of the invention is locks for tools that are used in a subterranean location where shear pins are avoided and the release device is in pressure balance for run in and when shifted with a pressure differential releases the retaining device that is preferably a collet.

BACKGROUND OF THE INVENTION

Components that are designed to hold their relative position until a specific subterranean location is reached at which time they are actuated to move relatively to operate various tools. Typically these parts are held together with shear pins. When the time comes for the tool actuation various techniques are used to break the shear pin and get the parts moving. There can be a ball seat that gets a ball followed by pressuring up to move one sleeve with respect to another where the shear pin extends in both sleeves. The result is that the shear pin shears and the parts move and the tool is actuated. It can be done by setting down weight or by picking up and setting down in a pattern in combination with a j-slot where after so many cycles there is a longer motion possible and the shear pin is sheared.

Shear pins can be a source of problems as they sometimes break at less than or greater than the force for which they are designed. Sometimes they shear in a way that a remnant of the shear pin gets jammed in between the relatively moving parts. When running a string into a wellbore there is frequently impacts on the wellbore wall and some of those can be hard enough to break a shear pin and get components moving at an inopportune time. This can have the result of setting a subterranean device/tool in an undesired location or in other cases require string removal to redress parts and to reset them to their original position for another try. Having to do this even once can be prohibitively expensive so that such occasions are to be avoided at all costs.

One solution to this problem that was tried in the past was to use a locking dog to prevent loads from reaching a shear pin until the dog was undermined such as with a ball landing on a sleeve that shifts with pressure to undermine the dog so that a force can reach the shear pin. This is illustrated in U.S. Pat. No. 7,503,390. Another approach is to use a locking collet that moves radially to release components for relative movement when urged by applied pressure as shown in U.S. Pat. No. 7,426,964. Other references that deal more generally with shear pin applications are U.S. Pat. Nos. 5,826,652 and 5,462,121.

The present invention in one embodiment replaces the shear pin or pins with one or more collets that are held captive in a groove by a pressure balanced piston that is insensitive to changes in tubing or annulus pressure. At a selected time, spaced apart ports that lead to opposed ends of the floating piston are isolated from each other so that pressure can build on one of the ports to move the sleeve preferably in the downhole direction to release the collet. The same pressure that releases the collet can move a sleeve in the opposite direction than the movement of the floating piston to actuate any number of different tools. These and other aspects of the present invention will be more readily apparent to those skilled in the art from a review of the detailed description of the preferred embodiment and the associated drawings while recognizing that the claims state the full scope of the invention.

SUMMARY OF THE INVENTION

Parts that need to be retained against relative movement are held with at least one collet that is captured in a groove with sleeve that acts as a piston. The piston is exposed to tubing pressure on opposed ends to be in pressure balance despite variations of pressure in the tubing. When it is desired to allow relative part movement to actuate the tool, one of the ports to the piston is isolated from the other and pressure drives the piston in a downhole direction. This releases the collet and pressure drives a sleeve in an opposite direction to actuate a tool. The parts can be optionally rotationally locked.

DETAILED DESCRIPTION OF THE PREFERRED EMBODIMENT

Figure 1A:
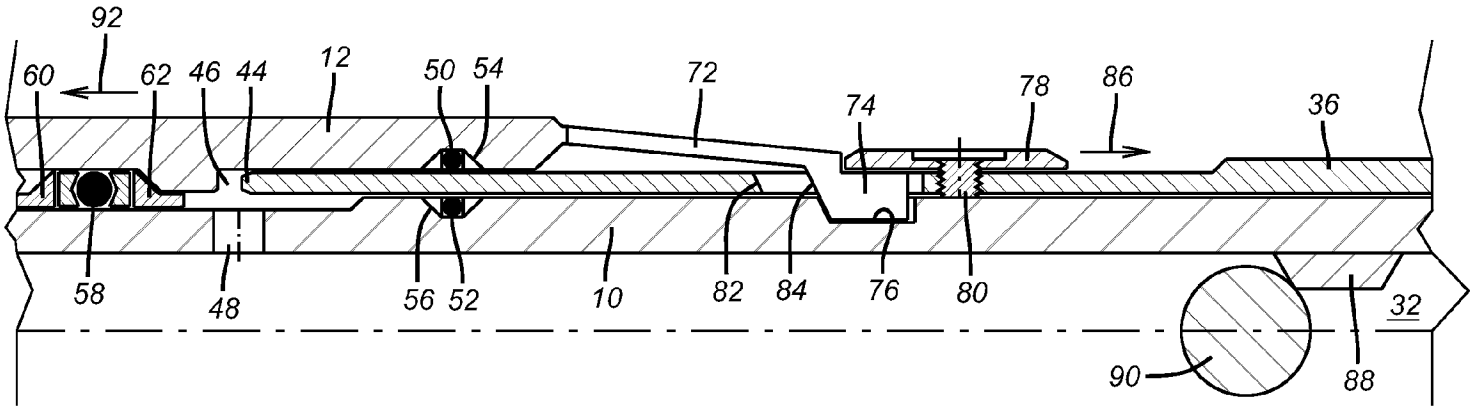
FIGS. 1*a*-1*b* are a section view of the tool in the run in position before a release for relative movement occurs.
Figure 1B:
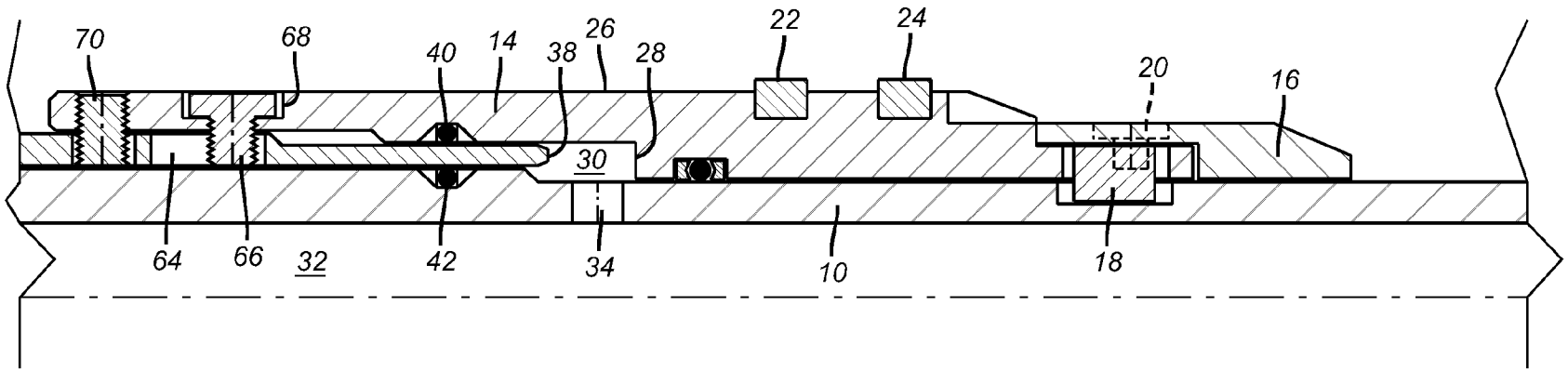

FIG. 1 shows a mandrel 10 and an actuator member or preferably a sleeve 12 whose movement relative to the mandrel 10 actuates a tool that is not shown. A lower sub 14 is secured to the mandrel 10 with a key 18 that is inserted through a slot in the lower sub 14 to straddle mandrel 10 and lower sub 14 to rotationally lock them together and to be retained in that position by sleeve 16 and fastener 20 shown in dashed lines. External hardened wear buttons 22 and 24 protect the outer surface 26 of the lower sub 14. An internal shoulder or undercut 28 creates a chamber 30 that is accessed from passage 32 in the mandrel 10 by port or ports 34. A release piston 36 that serves as a locking member has a lower end 38 in the chamber 30. Seals 40 and 42, respectively on the outside and inside of the release piston 36, seal off chamber 30. Pressure from passage 32 in the mandrel 10 that reaches the chamber 30 exerts an uphole force on the release piston 36.

End 44 of release piston 36 is in a chamber 46 defined between the mandrel 10 and the actuator sleeve 12. Access from passage 32 in mandrel 10 into the chamber 46 is through ports 48. Outer and inner seals 50 and 52 seal the release piston respectively to the actuator sleeve 12 and to the mandrel 10. Seals 50 and 52 are respectively mounted in grooves 54 and 56 that are respectively located in the sleeve 12 and the mandrel 10. Seal 58 is on the opposite side of ports 48 from seals 50 and 52 and is preferably retained on the actuation sleeve 12 by opposed backup rings such as 60 and 62. The same pressure at ports 34 and 48 will not put a net force on the sleeve 36 to move.

Sleeve 36 has a slot 64 in which rides a bolt 66 that extends from lower sub 14. The head of bolt 66 is in a recess 68 of the lower sub 14 to avoid grinding the head on the way into or out of the well. The presence of bolt 66 in slot 64 prevents independent rotation between the lower sub 14 and the sleeve 36.

Optionally, a shear pin 70 can initially connect the lower sub 14 to the sleeve 36 and is designed to break with minimal resistance when a net force is applied to the sleeve 36 from pressure into ports 48 with ports 34 isolated from that same pressure.

Actuator sleeve 12 has a series of collet fingers 72 that terminate in heads 74 that are held captive in groove 76 by sleeve 78 that is an extension of sleeve 36 that is secured with fastener or fasteners 80. Sleeves 36 and 78 together comprise a sleeve assembly that serves as the locking member to retain collet finger 72 in groove 76. Fingers 72 have a built in spring bias outwardly and away from groove 76. Sleeve 36 has a tapered surface 82 that preferably has the same slope as surface 84 on heads 74 so that movement of the sleeve 36 in the direction of arrow 86 has the result of retracting sleeve 78 from the position shown until the point where it no longer overlaps the heads 74 while at the same time surface 82 pushes the heads 74 out of groove 76 while working in tandem with the built in bias that lets the heads 74 spring out as sleeve 78 is retracted.

Within passage 32, a running/setting tool incorporates a seat 88 on which a ball 90 lands, both of which are schematically illustrated, to isolate port 34 from port 48. Pressure in the running tool on ball 90 pressurizes chamber 46 and puts an unbalanced force on sleeve 36 which results in snapping the optional pin 70 and freeing the collet heads 74 to now also allow actuating sleeve 12 to be pushed in the direction of the arrow 92 using the built up pressure in the chamber 46 to push on actuating sleeve 12 and its seal 58. Movement of the sleeve 12 actuates any one of a variety of downhole tools operatively connected to sleeve 12.

Figure 3:
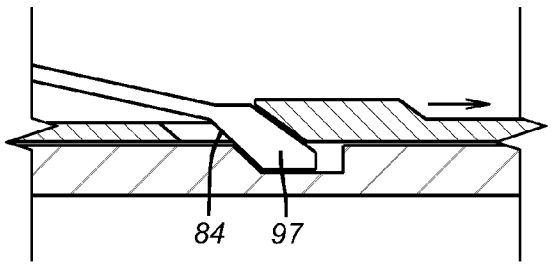
FIG. 3 is an alternative shape to the collet heads shown in FIG. 1*a;*
Figure 2:
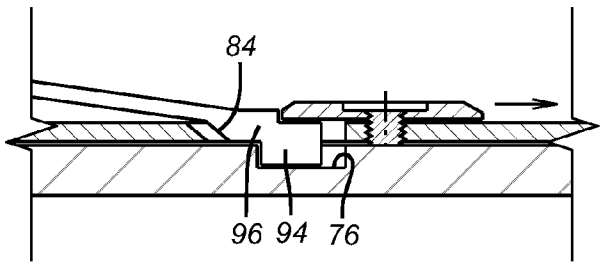
FIG. 2 is an alternative shape to the collet heads shown in FIG. 1*a;*

FIGS. 2 and 3 show alternative shapes for the heads 74. In FIG. 2 instead of a single block in groove the block that is the head 74 is in two offset interconnected stages 94 and 96. Sloping surface 84 is still there in this alternative embodiment. FIG. 3 has the heads 74 as a single block having more of a parallelogram or hockey stick shape 97 with sloping surface 84 integrated into one of the long dimensions.

Figure 5:
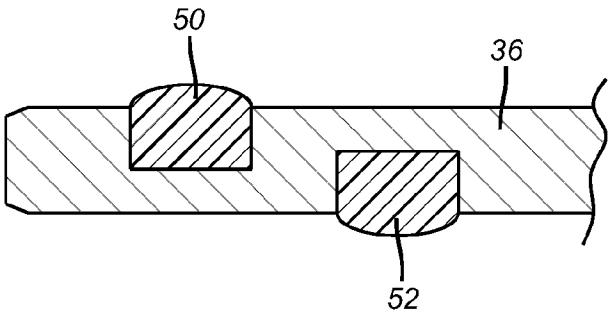
FIG. 5 shows an alternative design to the seals in FIG. 4.
Figure 4:
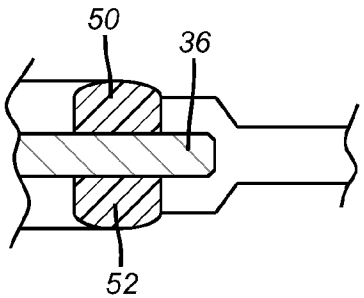
FIG. 4 is an alternative seal arrangement for the release piston showing one configuration of inner and outer seals mounted on the release piston.

FIGS. 4 and 5 illustrate some alternative layouts for the seals 50 and 52. They can be at the end of sleeve 36 as shown in FIG. 4 or axially offset along sleeve 36 as shown in FIG. 5.

Preferably the arrangement makes do without shear pins and the use of shear pin 70 is totally optional. Pin 70, if used is set at a low value. Sleeve 36 actuates by movement in the downhole direction as shown by arrow 86. For running in the hole, if any shock loads actually got to sleeve 36 that is exposed on the exterior of the assembly, such impact loads would not allow a release of the collet heads 74. While a ball 90 dropped on a seat 88 is one way to isolate ports 34 from ports 48, those skilled in the art will appreciate that other ways can be employed to selectively close ports 34 to allow pressure to move sleeve 36. Some examples can be manipulation of mandrel 10 in conjunction with a sleeve and a j-slot assembly to selectively cover ports 34 when needed to actuate the tool or straddling a ports 48 with swab cups on an actuation tool. While collet fingers 72 with heads 74 are preferred other configurations to hold the sleeve 12 to the mandrel 10 without using shear pins are also within the scope of the invention.

Alternatively sleeve 36 can in part be located in passage 32 and be integrated with a ball seat that accepts an object that shifts the sleeve 36 internally while it is linked to an external portion to the mandrel 10 that can release the dog 74.

Until the port 34 is isolated from port 48 any level of passage pressure in passage 32 will not move the sleeve 36 as it continues to be in pressure balance.

The above description is illustrative of the preferred embodiment and various alternatives and is not intended to embody the broadest scope of the invention, which is determined from the claims appended below, and properly given their full scope literally and equivalently.

We claim:

1. A pressure actuator assembly for a subterranean tool, comprising:

a mandrel having a passage therethrough and upper and lower end connections for attachment to a tubular string that extends to a predetermined location;

an actuating member selectively locked to said mandrel and relatively movable with respect to said mandrel when unlocked to actuate the tool;

a lock member exposed to balanced pressure in said passage from spaced passage locations, said lock member retaining said actuating member to said mandrel until said lock member is selectively moved by unbalanced pressure reaching said lock member from said passage.

2. The assembly of claim 1, wherein:

said lock member is selectively moved by pressure from said passage that reaches said lock member from a first location while a second location that otherwise reaches said lock member is isolated from passage pressure.

3. The assembly of claim 2, wherein:

pressure reaching said lock member to move said locking member it also subsequently moves said actuating member.

4. The assembly of claim 3, wherein:

said lock member moves in an opposite direction than said actuating member.

5. The assembly of claim 4, wherein:

said lock member comprises a sleeve mounted over said mandrel.

6. The assembly of claim 5, wherein:

said sleeve is directly or indirectly rotationally locked to said mandrel.

7. The assembly of claim 5, wherein:

said actuating member comprises at least one collet selectively retained by said sleeve to said mandrel.

8. A pressure actuator assembly for a subterranean tool, comprising:

a mandrel having a passage therethrough and upper and lower end connections for attachment to a tubular string that extends to a predetermined location;

an actuating member selectively locked to said mandrel and relatively movable with respect to said mandrel when unlocked to actuate the tool;

a lock member exposed to balanced pressure in said passage from spaced passage locations, said lock member retaining said actuating member to said mandrel until said lock member is selectively moved by unbalanced pressure reaching said lock member from said passage;

said lock member is selectively moved by pressure from said passage that reaches said lock member from a first location while a second location that otherwise reaches said lock member is isolated from passage pressure;

pressure reaching said lock member to move said locking member also subsequently moves said actuating member;

said lock member comprises a sleeve assembly mounted over said mandrel;

said actuating member comprises at least one collet selectively retained by said sleeve assembly to said mandrel;

said collet comprises a head in an exterior groove in said mandrel and selectively retained in said groove by said sleeve assembly.

9. The assembly of claim 8, wherein:

said collet extends through an opening in said sleeve assembly when retained in said groove.

10. The assembly of claim 9, wherein:

said opening in said sleeve assembly is defined by an opening surface substantially parallel to a collet head surface that is engaged by movement of said sleeve assembly.

11. The assembly of claim 10, wherein:

a portion of said sleeve assembly overlies said opening and said collet head until said sleeve assembly is moved to release said collet head from said groove.

12. The assembly of claim 11, wherein:

said collet is sprung to move away from said groove when said sleeve assembly no longer overlays said head.

13. The assembly of claim 12, further comprising:

a running/setting tool comprising a seat that accepts an object for isolating said second location in said passage from pressure in said passage communicated to said first passage.

14. The assembly of claim 13, wherein:

said sleeve assembly does not move at any pressure level in said passage until said object is first landed on said seat and pressure against said object is applied.

15. The assembly of claim 14, wherein:

said sleeve assembly is initially secured to said mandrel with at least one breakable member to hold said sleeve assembly against movement when run into a subterranean location;

initial movement of said sleeve assembly from pressure applied at said first location breaks said breakable member.

16. The assembly of claim 2, further comprising:

a running/setting tool comprising a seat that accepts an object for isolating said second location in said passage from pressure in said passage communicated to said first passage.

17. The assembly of claim 16, wherein:

said lock member does not move at any pressure level in said passage until said object is first landed on said seat and pressure against said object is applied.

18. The assembly of claim 8, wherein:

said head has a stair shape in section and said sleeve assembly selective overlies said stair shape.

19. The assembly of claim 8, wherein:

said collet has a hockey stick shape and said sleeve assembly has a sloping surface that selectively overlies said head.

20. The assembly of claim 4, wherein:

said lock member moves only toward said lower end of said mandrel.

* * * * *